United States Patent [19]

Rogers et al.

[11] Patent Number: 5,044,562

[45] Date of Patent: Sep. 3, 1991

[54] DUAL SPRAY DIRECTOR USING AN "H" ANNULUS

[75] Inventors: David W. Rogers; Kurt T. Hertzog, both of Henrietta; Jay K. Sofianek, Livonia, all of N.Y.; Lawrence W. Robinson, Rochester Hills, Mich.

[73] Assignee: General Motors Corporation, Detroit, Mich.

[21] Appl. No.: 546,993

[22] Filed: Jul. 2, 1990

[51] Int. Cl.[5] ..... F02M 51/06

[52] U.S. Cl. ..... 239/543; 239/552; 239/553; 239/585; 239/590; 239/596

[58] Field of Search ..... 239/552, 543, 553, 553.3, 239/553.5, 533.12, 585, 590, 590.5, 596

[56] References Cited

U.S. PATENT DOCUMENTS

| | | | |
|---|---|---|---|
| 752,803 | 7/1903 | Ross | 239/553.5 |
| 1,075,678 | 10/1913 | Wall | 239/552 |
| 2,718,714 | 9/1955 | Bocchino | 239/553.5 |
| 2,832,643 | 4/1958 | Bletcher et al. | 239/552 |
| 4,515,129 | 5/1985 | Stettner | 239/585 B |
| 4,646,974 | 3/1987 | Sofianek | 239/533 R |
| 4,699,323 | 10/1987 | Rush et al. | 239/552 |
| 4,925,111 | 5/1990 | Foertsch et al. | 239/585 |

*Primary Examiner*—Andres Kashnikow
*Assistant Examiner*—Kevin Weldon
*Attorney, Agent, or Firm*—Karl F. Barr, Jr

[57] ABSTRACT

An electromagnetic fuel injector has an orificed fuel director plate, mounted downstream of a solenoid actuated valve and an associated main orifice passage opened and closed by the valve, to receive fuel when the valve is pulled to an open position from its associated valve seat for controlling and directing flow from the injector. The upper surface of the orifice director plate is provided with a fuel distributing channel system terminating in separate pairs of cooperating injection orifices that are disposed adjacent to one another to direct adjacent jets of fuel which partially intersect one another producing discrete cones of atomized fuel accurately onto separate fuel intake valves of a piston cylinder of an internal combustion engine.

10 Claims, 2 Drawing Sheets

DUAL SPRAY DIRECTOR USING AN "H" ANNULUS

FIELD OF THE INVENTION

This invention relates to electromagnetic fuel injectors and in particular to an injector having an orifice director plate herein is downstream of the solenoid actuated valve element and that has an upper face channel system providing optimized distribution of fuel to terminal fuel injection orifices regardless of the amount of lift or position of the valve element from the valve seat to inject cones of atomized spray with quantities and direction optimized into separate intake valves of an internal combustion engine.

DESCRIPTION OF THE PRIOR ART

Electromagnetic fuel injectors are employed for internal combustion engines to effectively control the discharge of precise quantities of fuel per unit of time for optimized engine performance. Such fuel injectors are normally calibrated so as to inject this predetermined quantity of fuel prior to their installation in the fuel system of a particular engine.

An example of one such electromagnetic fuel injector is disclosed in U.S. Pat. No. 4,699,323 entitled "Dual Spray Cone Electromagnetic Fuel Injector" dated Oct. 13, 1987 and issued to James H. Rush et al. and assigned to the assignee of this invention. A director plate downstream of a solenoid control valve has two sets of three orifice passages or holes arranged on opposite sides of a vertical plane extending through the reciprocating axis of the valve so that the streams of fuel discharged therefrom partially impinge on each other whereby the two sets of orifice passages are operative to produce two diverging atomized cone fuel spray patterns for supplying fuel to two intake valves of a multi-valve per cylinder internal combustion.

While the six hole multiple plate dual cone director described in this prior patent has performed with good results, it is difficult and costly to manufacture and the spray patterns may not meet higher standards for optimized fuel delivery with effective part cost reduction. More particularly, with the prior art construction, the spray patterns were sensitive to the position and the amount of core ball lift so for example there was excessive skew angle (angular misdirection) of the fuel spray cones when the injector was used on engine applications requiring low or short lift. To make such an injector effective, costly and tedious part matching would be required for an even more closer fit of the parts so that the valve element still readily shifts and shifts with high precision to closely controlled positions along its longitudinal axis for an even flow of fuel onto the director plate for improving the targeting of the fuel spray cones. With the present invention, the above difficulties are obviated with a new and improved fuel injector which can be utilized in a wide range of engine applications with minimized skew and improved efficiency.

SUMMARY OF THE INVENTION

Accordingly, it is a feature object and advantage of the present invention to provide a new and improved electromagnetic fuel injector for use in a wide range of engine applications having an orifice director plate incorporated therein, downstream of the solenoid control valve of the injector and positioned at right angles to the reciprocating axis of the valve. The orifice director plate in the preferred embodiment is of nickel plate and has four orifices interconnected by a flow distribution system formed in the upper surface of the director plate. This system is a balanced fuel flow channel system that has passages which lead into each injector orifice so that dual and quantitatively equalized cones of fuel spray will be directed with minimized skew and maximized precision to the intake valves of an internal combustion engine regardless of the position of the core ball as it lifts from the valve seat located at the lower nozzle of the injector.

Another feature object and advantage of this invention is to provide a new and improved director plate for a fuel injector which has sets of injection orifices on opposite sides of a plane, extending through the axis, with the injection orifices arranged so that the streams of fuel partially impinge on each other, whereby two sets of orifices are operative in providing two diverging atomized cone fuel spray patterns for suppling fuel to separate intake valves for a multiple valve cylinder of an internal combustion engine.

Another feature object and advantage of this invention is to provide a new and improved electromagnetic fuel injector with matched set of injector orifices in a director plate inclined with respect to the shift axis of the valve and having a fuel distributing system interconnecting the injection orifices so that each injection orifice receives substantially the same quantity of pressure fuel producing matched multiple streams of fuel; adjacent streams of which interact to provide an atomized cone of fuel which accurately impinges upon a target such as the intake valve of an internal combustion engine.

Another feature object and advantage of this invention is to provide a new and improved electromagnetic fuel injector, having a valve element displaced at any selected amount of lift from a fuel feed orifice by movement of its core ball from its associated valve seat so that the director plate optimally distributes fuel flowing through the valve body by a flow directional system: the system terminating in injection orifices spaced such that two adjacent jets of fuel leaving adjacent orifices partially overlap, resulting in a directed cone of fuel that accurately impacts on a target such as the intake valve of a cylinder of an internal combustion engine.

Another feature object and advantage of this invention is to provide a new and improved director plate for a multiple spray cone electromagnetic fuel injector that has a generally H shaped fuel distribution system channeled within the inner face thereof which terminates at adjacent injection orifices at the end of each leg of the H pattern so that fuel fed thereto will be optimally distributed, regardless of the position of the controlling valve element from its valve seat, so that dual spray cones will be injected into the intake port and onto the intake valves of a combustion cylinder of an internal combustion engine without excessive wetting of the side walls of a septum dividing the intake valves from one another.

These and other feature objects and advantages of this invention will be more apparent from the following Detailed Description and Drawing which:

Figure 1:
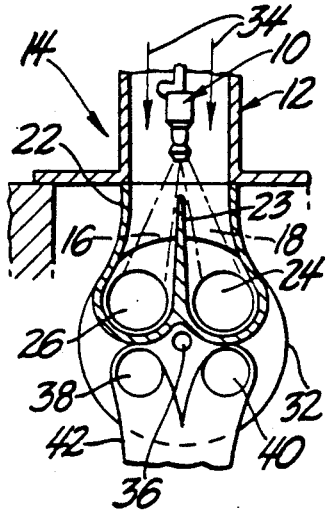
FIG. 1 is a schematic illustration of the induction system for supplying fuel to the intake valves of a cylinder of an internal combustion engine.
Figure 2:
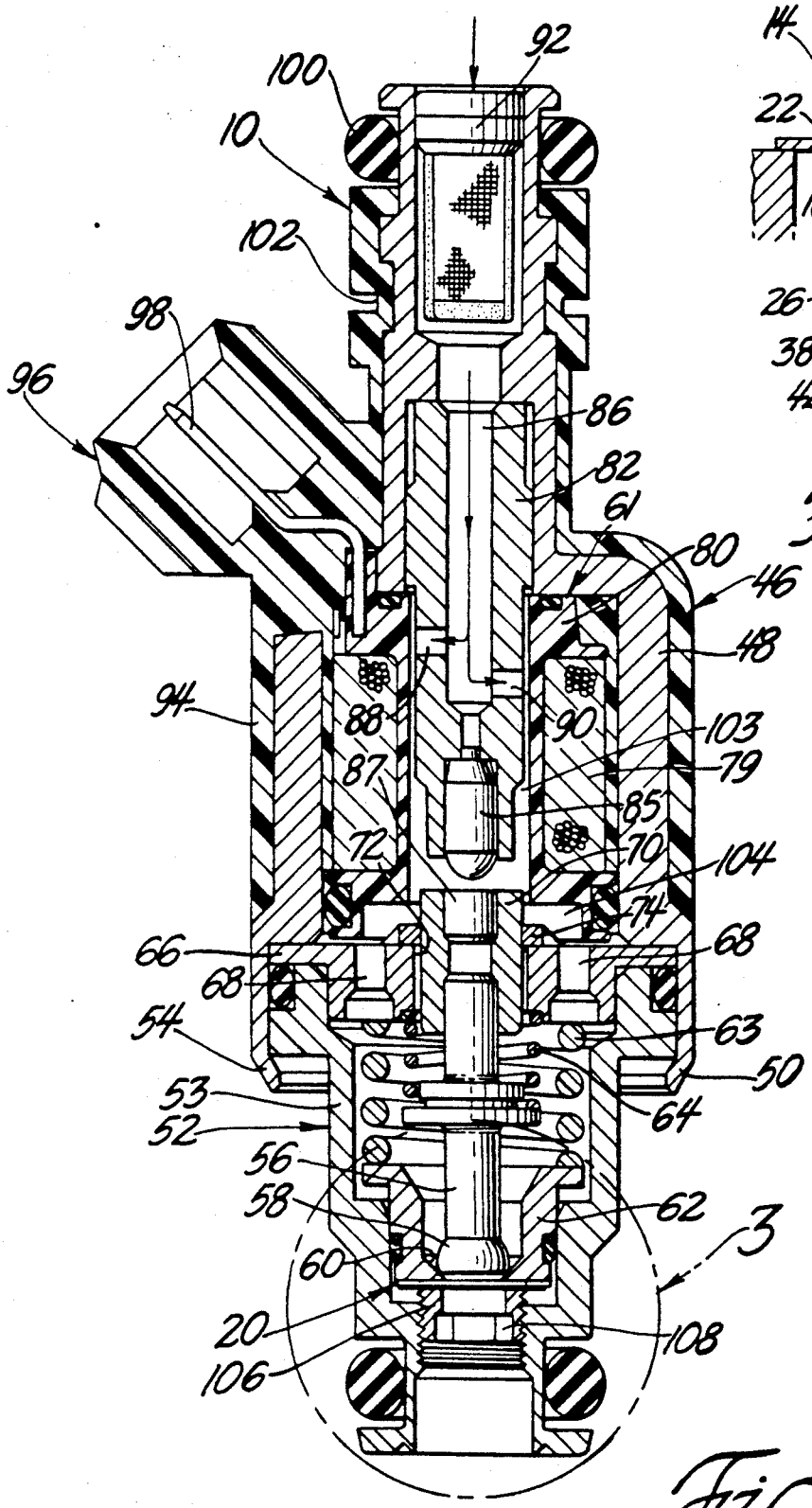
FIG. 2 is a longitudinal cross sectional view of an electromagnetic fuel injector incorporting a fuel director plate according to this invention for directing separate cones of spray fuel according to the present invention.

Turning now in greater detail to the drawing, there is diagrammatically shown in FIG. 1, fuel injector 10 operatively mounted in an intake manifold 12 of an internal combustion engine 14. This injector 10 is operative to inject a pair of discrete spray cones of fuel 16 and 18 through a special fuel director plate 20 operatively mounted within the lower end of the injector. These spray cones are accurately targeted to project, without wall wetting, through discrete passages of intake port 22 partitioned by a septum 23 onto separate intake valves 24 and 26 of a power cylinder 32 of the internal combustion engine. The spray cones 16 and 18 mixed with intake air, exemplified by flow arrows 34, flowing through the opened intake valves to provide a fuel air charge for the engine cylinder 30. This charge is ignited by a spark plug 36 on predetermined position of the piston in compression stroke. On exhaust stroke, the exhaust valves 38 and 40 open to discharge the exhaust gases from the cylinder 32 to an exhaust port 42 and then to an exhaust manifold not shown leading from the engine.

A preferred form of the fuel injector and the special injector plate providing the important benefits of this invention is shown in FIG. 2 through 5. The injector 10 with the exception of the director plate and its operation generally corresponds to the dual spray cone electromagnetic fuel injector of U.S. Pat. No. 4,699,323 dated Oct. 13, 1987 assigned to the Assignee of this invention and hereby incorporated by reference.

The injector 10 has an upper solenoid assembly 46 with a generally cylindrical and stepped diameter metallic shell 48 having a skirt portion 50 at the lower end thereof that receives the upper end of a nozzle assembly 52, which has a cylindrical stepped diameter main casing 53. The annular end 54 of the skirt portion 50 of the shell 48 is crimped inwardly to grip the enlarged head portion of the nozzle casing to fasten the nozzle assembly 52 to the lower end of the injector shell to rigidly secure these parts together.

Operatively mounted for linear movement within the nozzle casing 53, is a reciprocally moveable and elongated valve element 56 having at its lower end a semi spherical core ball 58, which is adapted to be moved from a seated and fuel sealing engagement with an annular valve seat 60 defining a flow orifice passage 51 of a cylindrical valve body 62 mounted within the nozzle casing that is yieldably held in position by an outer helical spring 63.

The valve element 56 is controlled in its movement by the electromagnetic force of a periodically energizable coil of a solenoid assembly operatively mounted in the injector shell and the opposing spring force of a helical return spring 64. The lower end coil of spring 64 is seated on a centralized large diameter collar formed on the valve element intermediate the ends thereof while upper end coil of spring 64 is seated on annular spacer disc 66 having axial fuel feed passages 68 extending therethrough.

Figure 3:
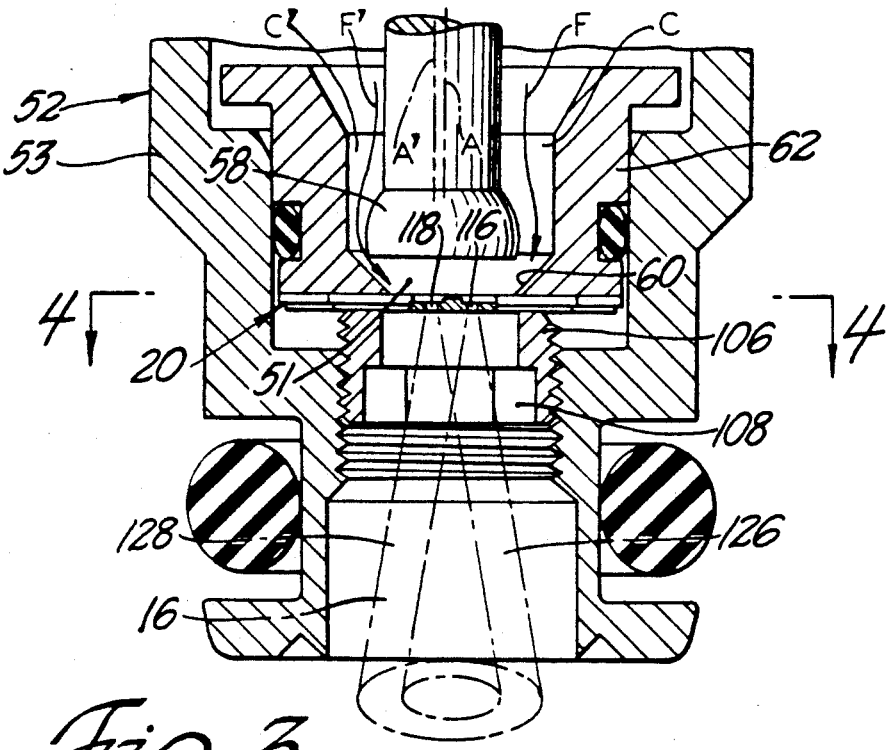
FIG. 3 is an enlarged view of the encircled lower end portion of the injector of FIG. 2 but with components moved so that the director plate directs cones of fuel to a target area.
Figure 4:
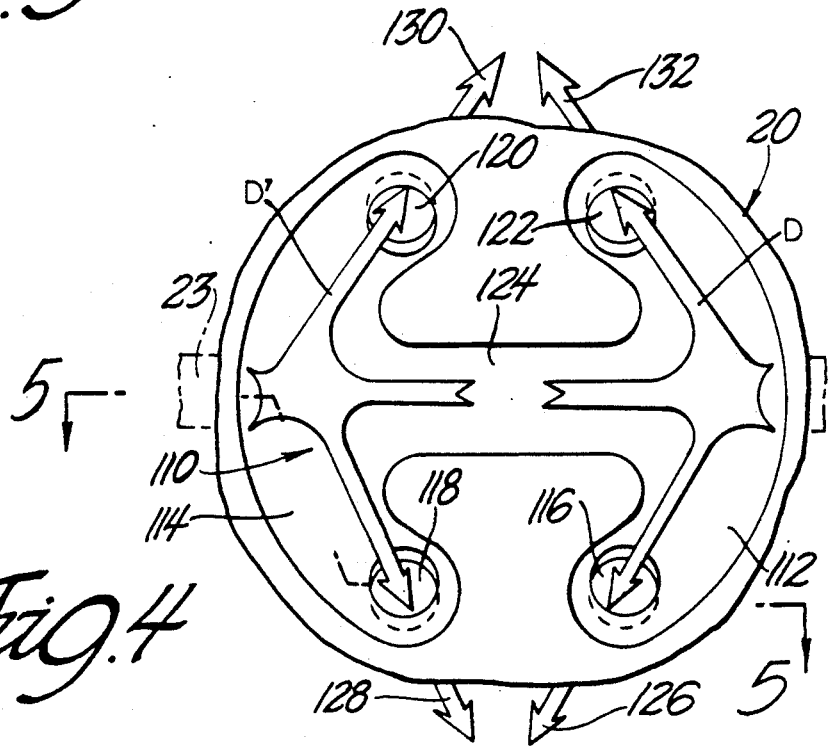
FIG. 4 is a top plan view of the director plate taken generally along sight lines 4—4 diagrammatically illustrating the fuel flow distribution pattern provided by the director plate of this invention.
Figure 5:
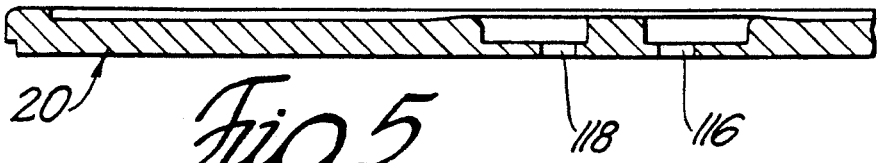
FIG. 5 is a sectional view taken along sight lines 5—5 of FIG. 4.

The cylindrical upper end of the valve element 56 is press fitted into a cylindrical armature 70 which strokes with radial clearance in a centralized annular opening 72 in the spacer disc 66 and in the guide washer 74 fixed atop of the spacer disc. Due to the normal limit stack dimensional variations and particular those in the spacer disc, guide washer and armature, variations occur in the centering or alignment between core ball with respect to its valve seat and the surrounding wall of the valve body. Accordingly on valve lift, fuel flow around the core ball varies with the amount of vertical lift from its valve seat and its radial displacement from the center line of the injector. Such variation may result in an uneven distribution of fuel flowing around the core ball, as illustrated in FIG. 3 which shows the core ball 58 lifted a predetermined vertical distance from valve seat 60 by action of the solenoid assembly. In this position the axis A' of the core ball may be radially or otherwise offset a sight amount from the vertical axis A of the valve seat 60 of the injector 10. Under such conditions, there is more fluid flow clearance on one side of the core ball than the other as illustrated by clearances C and C' Accordingly, flow capacity on one side of the core ball, clearance C, is larger than the other side, clearance C' and a larger quantity of fuel flows to the flow orifice passage as through clearance side C compared to the opposing side of the core ball. With unequal flow of fuel around the core ball onto the director plate as indicated by flow arrows F, F', difficulties have been experienced in optimizing injection of fuel onto the intake valves particularly in installations in which there is maximized core ball lift as determined by a stop mechanism described below. However, the valve director disc of this invention is substantially independent of the position of the core ball and will distribute fuel impinging thereon to the matched pairs of injection orifices 116 118 and 120, 122 in the fuel director plate 20 as best shown in FIG. 4.

Valve lift occurs on energization of a coil 79, the turns of which are wound on a bobbin 80 made of insulated plastics material which encompass an elongated solenoid stator 82 that forms the core of the solenoid assembly. A stop 85 pressed into the lower end of stator 82 contacts the end of plug 87 pressed in armature 70 to limit the amount of vertical lift of the valve. The stator has a centralized fuel flow passage 86 leading from its upper end to radial intermediate flow passage 88 and 90. Low pressure fuel is fed to the centralized stator passage 86 through a fuel filter unit 92 operatively mounted in an inlet chamber provided in the reduced diameter upper end of the metallic shell 48.

As shown, the shell is encased within a tough insulating plastics material 94, which is formed with an elongated side socket 96 having a pair of electrical leads, one of which is shown at 98 that operatively connects the coil 79 to a control source of electrical power which affects the electromagnetic operation of a fuel injector by pulses fed thereto from a controller not shown.

The upper end of the fuel injector 10 is fitted with an O-ring 100 and has as annular connector groove 102 for leak free attachment to a fuel line in a conventional manner.

When the core ball 58 is lifted from its seat for fuel injection, low pressure fuel can flow through the fuel filter 92 and the stator via the central and radial passages therein. From the radial passages, the fuel flows through the annular passage 103 around the lower end of the stator and then into an annular cavity 104 at the lower end of the solenoid bobbin 80. The fuel then flows through the axial passages 68 in the spacer disc and around the core ball in varying patterns through clearances C and C' as described above and through the central opening 51 defined by the annular valve seat 60 in the valve body 62 and onto the flow director plate 20 of this invention.

The flow director plate 20 is supported in fixed position between the lower end of the valve body 62 and a cylindrical retainer 106 which is adjustably threaded into an inner diameter of nozzle casing 53 by means of conventional tooling having a hex head which fits into the opening 108 formed within this retainer.

In FIG. 3, the core ball is lifted from the valve seat a predetermined distance from its valve seat as determined by stop 85 shown in FIG. 1. As indicated above, in high quantity production limit stack variations occur so that the core ball of one injector might be lifted to a slightly different height than the core ball of another injector, and could be offset from the center line by a distance slightly more or less than that of a second unit. Regardless of amount of axial lift or amount of radial offset within tolerances, the present invention provides substantially equalized dual spray cones of fuel 16, 18 which are directed through discrete passages of intake port (22) on either side of the septum and are directed with precision onto the two intake valves. Furthermore, the injector of this invention can be used in a wide range of engines since targeting of the fuel spray is not sensitive to core ball location. In particular, this invention can be used with engines requiring low lift as well as those requiring high lift of the core ball.

One preferred embodiment of the fuel director plate 20 is shown in FIG. 4 in which a channeled H shaped fuel flow distribution system 110 is formed in the upper face of the director plate. As illustrated, the side legs 112, 114 of the system are opposing arcs of a circle and the terminal ends of these legs have fuel injection orifices 116, 118 and 120, 122 formed therein such as by electron discharge machining at set predetermined angles with respect to the plane of the director plate. The two arcuate legs 112, and 114 are hydraulically interconnected by a wide central diametrical channel 124. With this distribution pattern, fuel flowing onto the director plate under low pressure will follow paths of least resistance and be distributed substantially equally in quantity to the four injection orifices 116, 118 and 120, 122 as diagrammatically illustrated by flow distribution arrows D, D'.

In this system closely adjacent orifices are engineered to cooperate with one another to provide the desired cones of fuel spray 16 and 18. Accordingly, the equalized streams of fuel 126 and 128 will partially intersect one another as diagrammatically illustrated in FIG. 3 to limit spray cone diameter and thereby prevent wall wetting and to provide improved directional control for impingement onto intake valve 26 of fuel spray cone 16.

Fuel spray cone 18 is similarly provided by the partial intersection of streams of fuel 130, 132 through orifices 120 and 122 to impinge upon intake valve 24 with accurate targeting and without sensitivity to core ball location.

The H pattern distribution system eliminates or substantially reduces skew angle so that there is substantially no wetting of the walls of the intake and the spray will be more accurately targeted onto the intake valves for improved engine performance, and particular when there is requirement for high torque response with appropriate quantities of fuel for acceleration purposes. This invention, as indicated, eliminates rich fuel during deccelaration because there will be minimized fuel on the port wall for all applications.

It will be apparent to those skilled in the art, that the electromagnetic fuel injector having an orifice director plate in accordance with the present invention could also be used to supply fuel to adjacent cylinders of an engine of the type having a single intake valve and single exhaust valve associate with each cylinder. Alternatively, the electromagnetic fuel injector could be used to supply fuel to the two bores of an otherwise conventional two bore throttle body injection system.

Accordingly, the application is intended to cover the illustrated and other modifications or changes as may come within the scope of the following claims.

We claim:

1. A director plate for an electromagnetic fuel injector for discharging fuel into the combustion chambers of an internal combustion engine, said director plate having a centralized axis and an upper surface with opposing discrete fuel distributing channel means therein for distribution of fuel supplied thereto, a plurality of associated pairs of spaced apart injector orifice means at predetermined locations in said discrete channel means and extending through said director plate, each of said injector orifice means being inclined at a predetermined angle to said central axis so that associated pairs of said injector orifice means will direct streams of fuel toward said central axis which partially intersect one another whereby said streams from each associated pair of injector orifice means will at least partly impinge upon each other to produce a fuel spray pattern which impinges on a preselected target.

2. An orifice director plate according to claim 1 wherein said discrete channel means are hydraulically interconnected by an intermediate channel and wherein substantially equalized streams of fuel from each of a pair of said injector orifice means will at least partly intersect each other and combine to form generally conical spray patterns separate from one another.

3. An orifice director plate according to claim 1 wherein the axis of each pair of said injector orifice means is located so that streams of fuel from said injector orifice means will intersect and combine to form generally conical spray patterns with minimized deviation in skew angle from said central axis.

4. An orifice director plate for use in an electromagnetic fuel injector of the type used to discharge fuel into the combustion chambers of an internal combustion engine, said orifice director plate having with opposed upper and lower surfaces and with a central axis, a pair of discrete arcuate fuel distribution passages formed therein, a plurality of pairs of circumferentially spaced injector orifice means located in said distribution passages and positioned radially outward of said central axis, the axis of each said injector orifice means being inclined at a predetermined angle with respect to said central axis and the plane of said orifice plate whereby each said injector orifice means of one pair will direct a stream of fuel so that only a portion of said stream will intersect and partly impinge upon each other to produce a generally conical spray pattern of atomized fuel with minimized optimized skew deviation angle from said central axis for optimized impingement upon a target.

5. An electromagnetic fuel injector used to discharge separate sprays of fuel to separate intake valves of a combustion chamber of an internal combustion engine, said injector having a valve member movable between open and closed positions with respect to a valve seat, a fuel director plate having opposed upstream and downstream surfaces in terms of the direction of fuel flow, said upstream surface having a generally H shaped fuel collection and distribution pattern formed by channels therein, a plurality of circumferentially spaced apart fuel injector orifices at the ends of each leg of the H shaped pattern, the axis of each said injector orifice being inclined axially downward from said upstream surface toward said downstream surface at an angle with respect to said central axis and radially extending toward said central axis, the axis of each of said injector orifices aligned so that equalized streams of fuel collected and distributed by said channel and flowing through said injector orifices intersect with each other whereby separate cones of fuel are produced that impinge on the separate intake valves.

6. An orifice director plate for an electromagnetic fuel injector for an internal combustion engine, said orifice director plate including a disk in the form of a body having an axis and having opposed surfaces, a plurality of equally spaced apart, injector orifice passages located on a circumference of a base circle positioned concentric to said axis, a pair of discrete curved fuel distribution passage means partially coinciding with said base circle and cooperating intermediate distribution passage means joining said pair of distribution passage means formed in said upper surface to distribute fuel to each of said injector orifices with each said injector orifice having fuel discharge axis inclined downward at a predetermined angle with respect to said axis and extending radially inward whereby the streams of fuel discharged from said injector orifices are substantially equal in flow volume and have minimized skew angle and at least partly impinge upon each other so as to produce a pair of discrete and equalized conical discharge fuel spray patterns.

7. An orifice director plate according to claim 6 wherein the axis of each said injector orifices is located closely adjacent one another whereby the streams of fuel from said injector orifices will partly intersect each other and combine so as to form a spray pattern with minimized skew angle and optimized target impingement.

8. An orifice director plate according to claim 6 wherein the axis of each said injector orifice is located so as to direct streams of fuel into intersection with each other, combining to form separate cones of fuel spray with optimized target impingement.

9. A dual fuel spray director plate for a fuel injector unit having upper and lower surfaces, a channeled fuel distribution system formed in said upper surface, said system having opposing curved leg portions, each leg portion having terminal ends, said terminal ends of adjacent leg portions being adjacent to one another, a fuel injector orifice angled with respect to the plane of said director plate disposed near the terminal ends of said leg portions to form adjacent pairs of injector orifices, and said channel system including a cross channel portion operatively innerconnecting said leg portions so that fuel directed onto said upper surface will be distributed to each of said injection orifices in substantially equal quantities so that said pairs of injector orifices will cooperate to inject separate discrete streams of fuel directed onto a predetermined target.

10. A fuel injector for injecting discrete spray streams of fuel to intake valve means of an internal combustion engine, said injector having a valve element with a curved core ball and a valve seat, defining a fuel flow passage with said core balls for receiving said core ball to block the flow of fuel through said flow passage, actuator means for moving said core ball to a fixed lift position off of said valve seat to allow the flow of fuel through said injector, the improvement comprising a flattened fuel director plate operatively mounted downstream of said flow passage, said director plate having pairs of injection orifices extending through said plate and a discrete fuel flow distribution channel means formed therein for optimally distributing fuel to of said injection orifices, said channel means having discrete arcuate segments, each of said segments having one of said injection orifices adjacent the end thereof, and an intermediate channel portion hydraulically interconnecting said arcuate segments for enhancing the even distribution of fuel to said injection orifices at the displaced position of said core ball with respect to said valve seat.

* * * * *